US005833351A

United States Patent [19]

Marsh

[11] Patent Number: 5,833,351

[45] Date of Patent: Nov. 10, 1998

[54] STRUCTURAL BUILDING UNIT

[76] Inventor: Neville Richard Marsh, 40 Waterleat Close, Paignton, Devon TQ3 3UN, Great Britain

[21] Appl. No.: 403,486

[22] Filed: Mar. 14, 1995

[51] Int. Cl.[6] ..... F21S 5/00

[52] U.S. Cl. ..... 362/145; 362/152; 52/306

[58] Field of Search ..... 362/145, 147, 362/153, 153.1; 52/306

[56] References Cited

U.S. PATENT DOCUMENTS

| | | | |
|---|---|---|---|
| 4,223,377 | 9/1980 | Williams | 362/145 |
| 4,326,012 | 4/1982 | Charlton | 52/306 |
| 4,969,282 | 11/1990 | Eberhart | 40/545 |
| 5,006,967 | 4/1991 | Diamond | 362/147 |
| 5,390,090 | 2/1995 | Nau | 362/145 X |

FOREIGN PATENT DOCUMENTS

| | | |
|---|---|---|
| 501794 | 6/1939 | United Kingdom . |
| 657107 | 12/1951 | United Kingdom . |
| 0888932 | 7/1958 | United Kingdom . |
| 0892123 | 7/1958 | United Kingdom . |
| 1177367 | 6/1967 | United Kingdom . |
| 1205935 | 2/1968 | United Kingdom . |
| 1241518 | 2/1969 | United Kingdom . |
| 1294308 | 12/1969 | United Kingdom . |
| 1495951 | 12/1994 | United Kingdom . |

*Primary Examiner*—Stephen F. Husar
*Attorney, Agent, or Firm*—Harold L. Novick; Nath & Associates

[57] ABSTRACT

A structural building unit comprises a hollow load-bearing body, preferably of rectangular parallelepiped shape, at least one of the faces being transmissive to electromagnetic radiation, preferably light, and the interior of the body being adapted for receiving a radiation-emitting or a radiation sensitive device. Such building units are preferably shaped and sized similar to conventional house bricks and may be incorporated in walls to provide illumination or security devices.

7 Claims, 5 Drawing Sheets

STRUCTURAL BUILDING UNIT

This invention relates to structural or load-bearing building units such as house bricks and to means for providing illumination in walls formed from such units.

Traditional house bricks are generally formed from fired clay and are of rectangular parallelepiped shape having two major and four minor faces. In use in constructing a wall, the bricks are arranged in courses with the major faces oriented horizontally, the exposed minor faces forming the surface of the wall. In order to provide illumination, for example of pathways, steps or other pedestrian or vehicular paths, it is necessary to attach a light unit to or in proximity to the wall. Alternatively, ground-embedded uplighting units may be used.

It is an object of the present invention to provide an improved wall lighting unit which may be used for ambient lighting purposes, safety purposes or for the display or presentation of information. It is another object of the invention to provide a security unit for use in walls.

According to the invention, a structural building unit comprises a hollow load-bearing body having essentially planar opposed faces which in use are disposed horizontally, at least one other face being transmissive to electromagnetic radiation and the interior of the body being adapted for receiving a radiation-emitting or a radiation-sensitive device.

Preferably, the unit is of rectangular parallelapiped shape.

For certain applications, notably in the field of security devices, to be understood as including devices for the monitoring of weather or natural phenomena, the electromagnetic radiation of interest may be in the microwave, radio wave, infra red or other region of the invisible electromagnetic spectrum. However, for most purposes, the electromagnetic radiation of interest will be in the visiable range and accordingly, throughout the remainder of this specification, the radiation will be referred to for convenience as "light", this term to be understood as meaning electromagnetic radiation in general unless the context requires a more specific interpretation.

Preferably, the unit according to the invention has the dimensions of a house brick and at least one of the minor faces is light-transmissive, whereby the unit may be incorporated in an array of similarly sized bricks forming a wall, the or a light transmissive face being oriented to lie in the front surface of the wall. Where two faces are light-transmissive, they are preferably adajacent faces whereby, if the unit is incorporated at the external corner of a wall, the two light-transmissive faces lie in respective front and side surfaces of the wall, allowing light transmission or sensing over an arc of up to 270°. In such an arrangement, the unit may be positioned either way up, to allow side lighting to the left or to the right.

In use, the unit may incorporate a light source or a light detector or other light sensitive transducer, together with any required ancillary equipment. For example, a suitable light source may comprise a low-voltage fluorescent tube, advantageous because of the relatively low heat output, ancillary equipment including ballast or electronics, connections to a source of power, a remotely-activable switch which may be automatically triggered, and the like; a suitable light detector may comprise a television camera, a still camera, a movement detector or other active or passive sensor or transducer. The unit preferably also includes light reflector means, either to distribute emitted light over a wide angle or to focus incident light on the detector.

By "load-bearing" is generally meant a structural unit which meets the requirements of British Standard BS 3921:1985 relating to clay bricks, especially in terms of satisfying the compressive strength test, whereby the unit is suitable for use for any construction purpose, in association with standard bricks. However, a lighter-duty unit for use, for example, in garden retaining walls would be within the scope of the invention, provided that it had sufficient strength and rigidity for that purpose. In order to provide the required strength, the unit may be made from toughened glass or a suitable plastics material such as a polycarbonate or a carbon-reinforced plastics material, and may include internal strengthening ribs or braces to enhance the crush resistance or to resist any tendency to deform under load. Such ribs or braces may be made from the same material as the body or from a metal or alloy material. In an alternative arrangement the unit may comprise a carcass forming the walls, an internal branching member being removably insertable for example by sliding within the carcass. Conveniently, in such an arrangement, the internal bracing member may provide support or mounting positions for the light source or light detector and ancillary equipment.

Units according to the invention are preferably rendered fluid-tight, that is, able to prevent ingress of liquids and gases, especially for use in flammable atmospheres, although for general purpose applications it may be sufficient to prevent ingress of liquid water while providing for internal ventilation to enable any condensed water vapour to evaporate. In order to provide for liquid tightness, the light transmissive faces, preferably comprising translucent panels, have resilient, water-resistant gasket means between themselves and the body of the unit. Where the unit includes an aperture for permitting entry of an electrical flex, the aperture may be sealed by a resilient grommet which may, for example, be wedge-shaped and include chamfered edges which in use are urged into sealing engagement with the edges of the aperture, the wedging effect thereby created also tending to seal the hole in the grommet about the flex.

The external faces of the unit which are not light-transmissive, or at least the upper and/or lower faces, may be provided with keying means for mortar, while still being essentially planar. Such keying means may comprise a conventional frog.

Optionally, the light-transmissive panels may be provided with colours or coloured filters which may be removably installed; direction arrows, logos, fire-escape signs, no entry signs or other information displays may be provided on a similar basis. For additional security, the rear wall of the unit may be provided with a bar or plate which extends beyond the side and/or top and bottom faces, to engage behind adjacent bricks in the wall and prevent the unit from being removed forwardly. The front-facing light-transmissive panel may be removable, to afford access to the interior, and may be held in place by security-headed bolts or provided with a locking mechanism to prevent removal by an unauthorised person; the locking mechanism may be releasable by a bar code reader or a fingerprint or magnetic card reader as well as by a conventional key.

Building units according to the invention may find application, in addition to light or information-imparting uses, in security units, surveillance units, radio transmission, air pollution monitoring, weather monitoring, radiation detection, seismic monitoring, stress analysis in buildings and in moisture detection.

Embodiments of the invention will now be described by way of example with reference to the accompanying drawings, of which:

Figure 1:
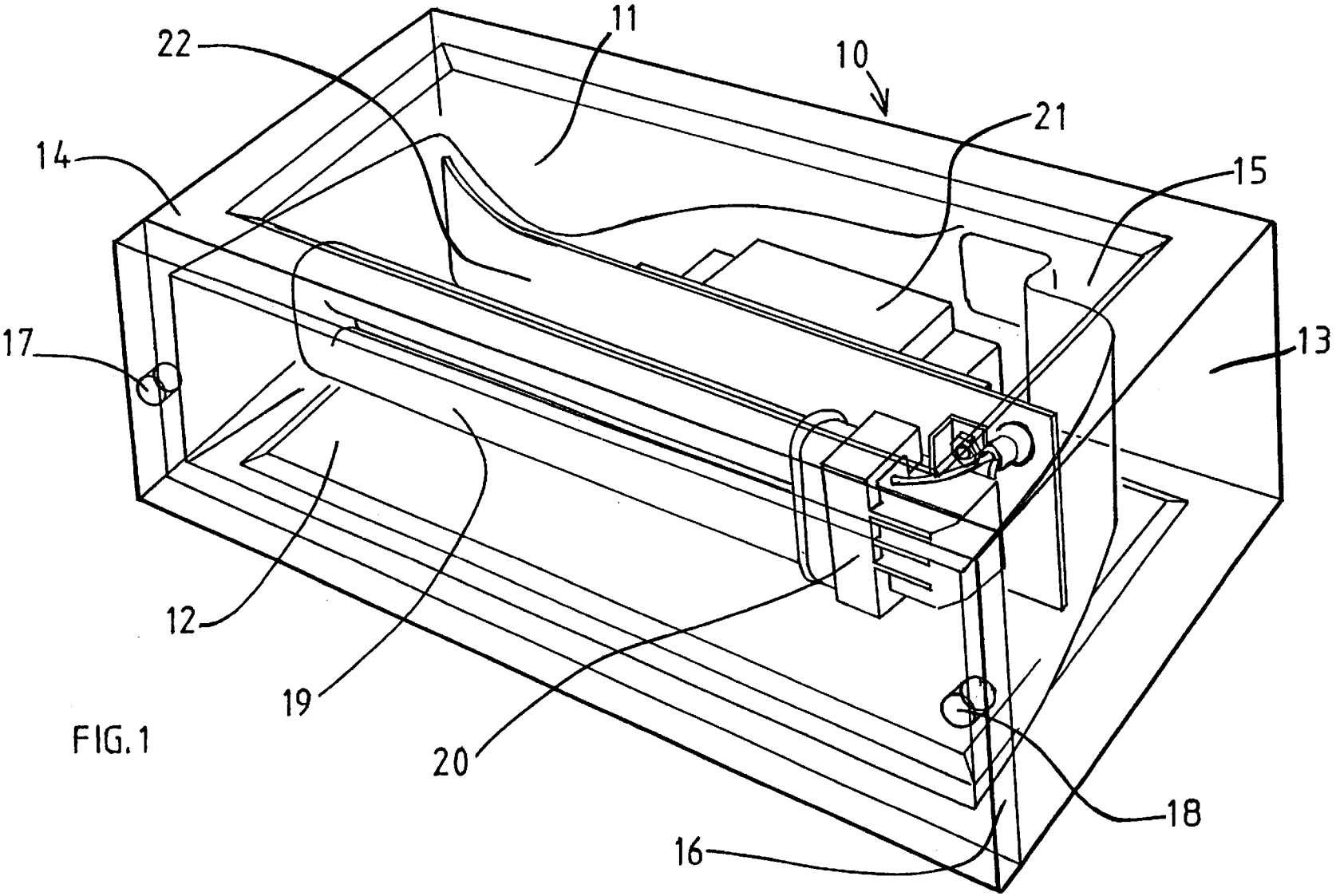
FIG. 1 is a transparent perspective view from the front of one form of light-incorporating structural unit according to the invention.

Referring firstly to FIG. 1, the unit consists essentially of a housing shown generally at 10 having major upper 11 and lower 12 faces, minor end faces 13, 14 and a minor rear face 15. The exterior of the upper and lower faces 11, 12 is formed with a conventional frog, to assist in keying of mortar when in use in a brick wall. The front minor face 16 is constituted by a transparent panel held in place by screws 17, 18; a resilient gasket (not shown) is interposed between the transparent plate 16 and the front edges of the housing. The housing contains a low-energy fluorescent tube 19 inserted in a connection piece 20, itself connected to the ballast or electronics 21. The ballast or electronics is separated from the light by a reflector 22 which concentrates light flux through the transparent panel 16. The ballast or electronics is connected to an electrical power source by means of cables (not shown) which extend through the rear wall 11 of the unit.

Figure 2:
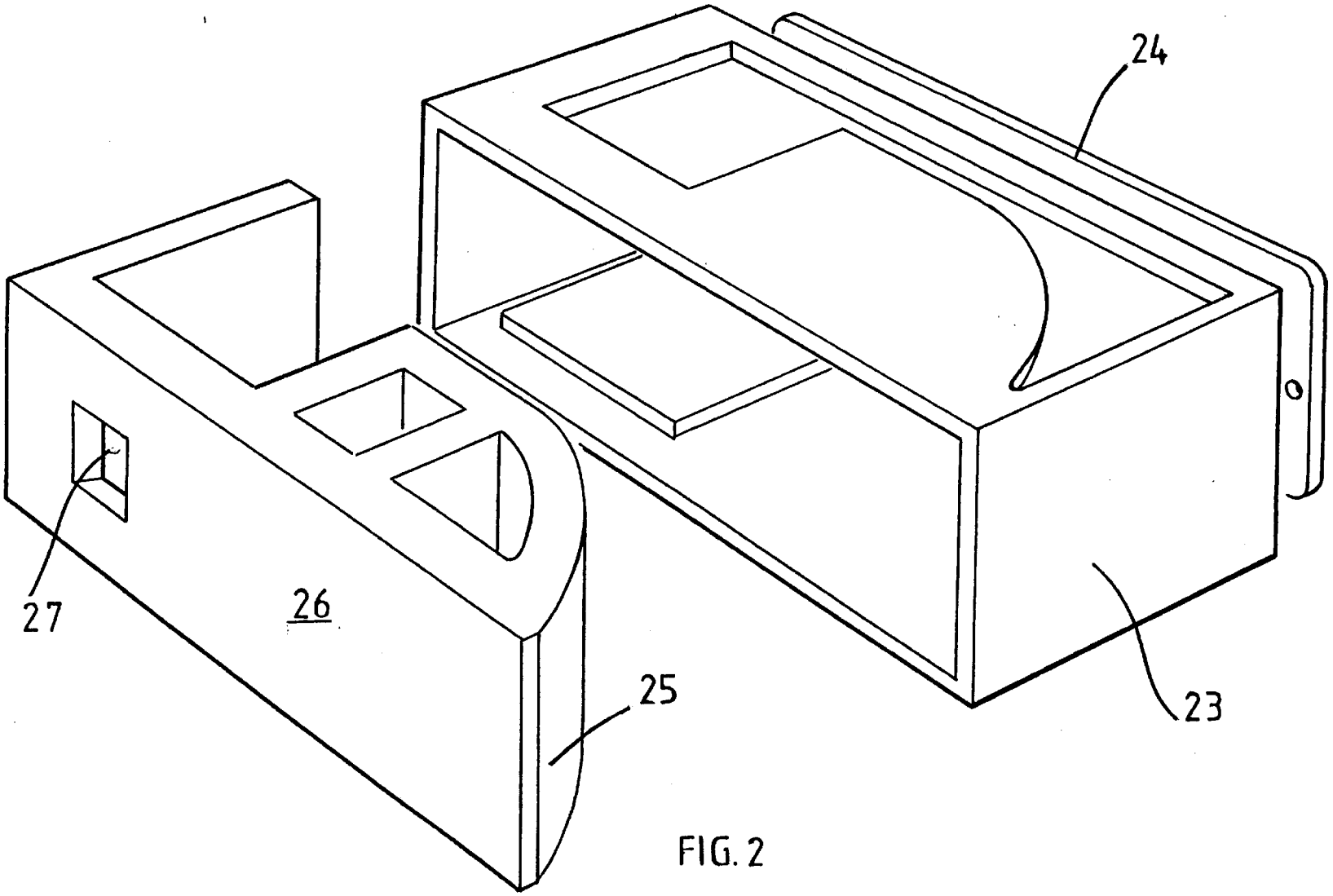
FIG. 2 is an exploded perspective view from behind showing the housing of another form of unit according to the invention.

With reference to FIG. 2, the unit consists essentially of a carcass 23 having a transparent front plate 24 attached thereto in a similar manner as shown in FIG. 1; a strengthening or bracing insert 25 is slidable into the housing through the open rear face and, once fully inserted, constitutes the rear wall 26. An aperture 27, sealable by a grommet (not shown) is provided for introduction of electrical cable. With the insert 25 fully engaged within the housing 23, there is space for the light components therein, similar to the arrangement shown in FIG. 1.

Figure 3:
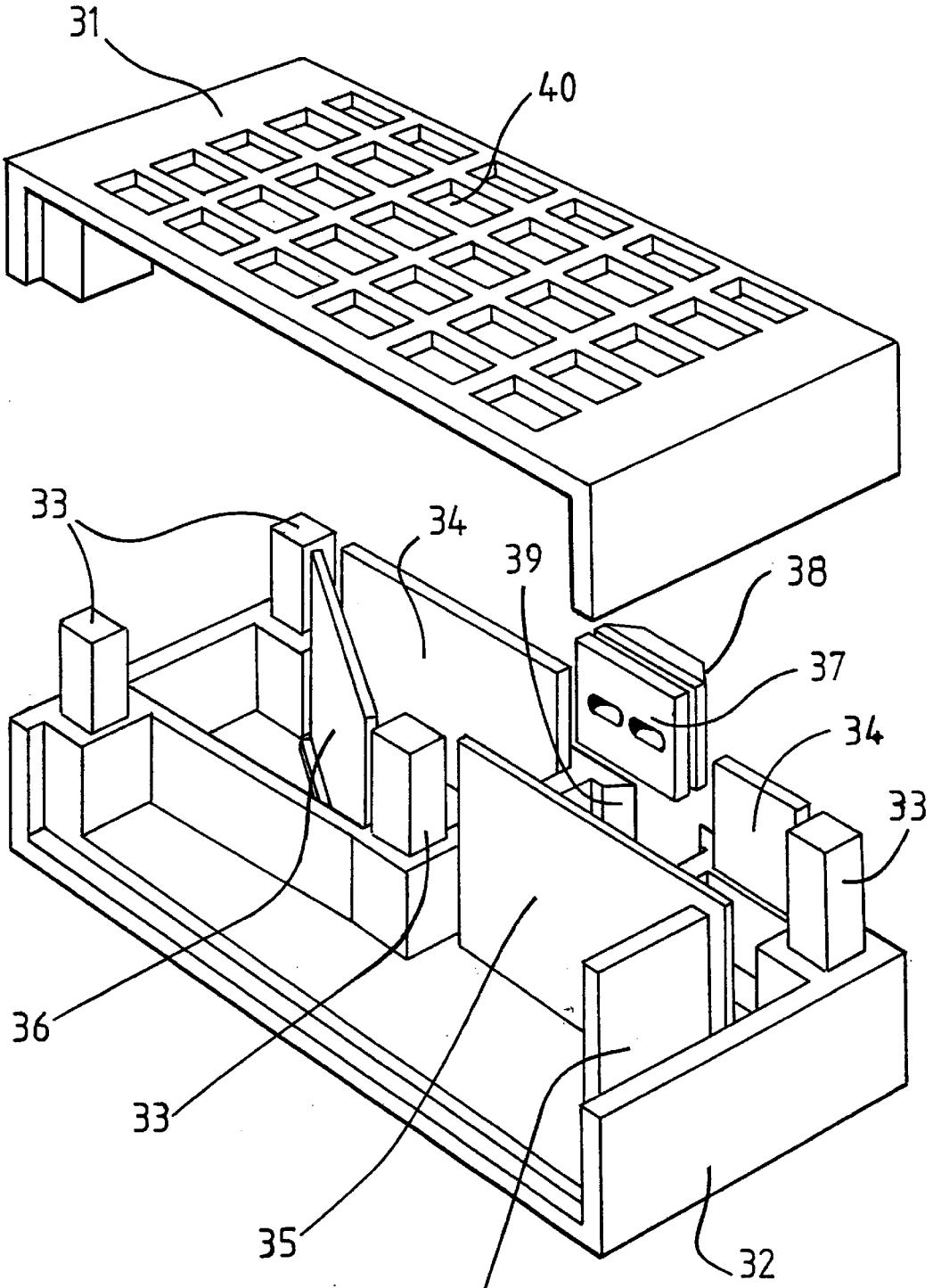
FIG. 3 is an exploded perspective view from the front showing the housing of yet another form of structural unit according to the invention.

With reference to FIG. 3, the structural unit is formed as upper 31 and lower 32 halves which are mated together after insertion of the light source and ancillary components. Vertical strengthening posts 33 and plates 34 increase the crush resistance of the completed unit. Internal reflectors 35, 36 are provided, again for filling the dual role of separating the light source from the ballast or electronics compartment and providing for reflection of emitted light. Reflector 36 is positioned at an angle whereby, if the adjacent end face were constituted by a translucent panel, light would be reflected through the end of the unit as well as through the front face. A resilient grommet 37 is provided to seal the aperture for the cable; the grommet has chamfered edges 38 which engage and are urged into contact with mating chamfered edges 39 formed at the sides of the cable aperture. The upper surface of the top member 31 is formed with depressions 40 for keying with mortar in use.

Figure 4:
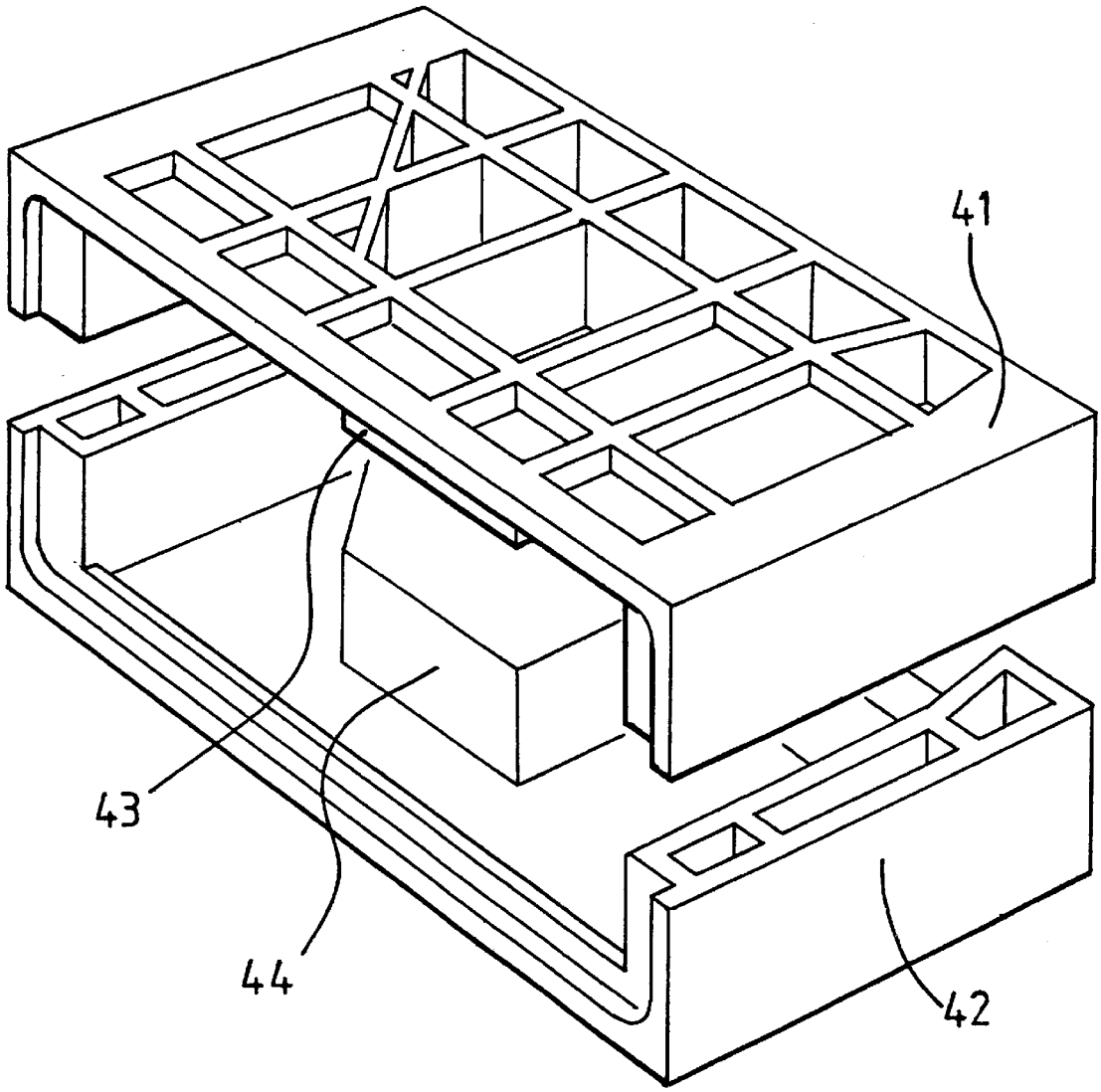
FIG. 4 is a view similar to FIG. 3 of a further structural unit.

FIG. 4 shows yet another arrangement, again using upper 41 and lower 42 mating halves. The end walls are of double thickness with a gap therebetween, for additional compressive strength. The upper and lower halves are formed with central half-pillars 43, 44 the facing surfaces of which abut together when the two halves are in mating relationship and which add to the compressive strength in the central region of the unit.

Figure 5:
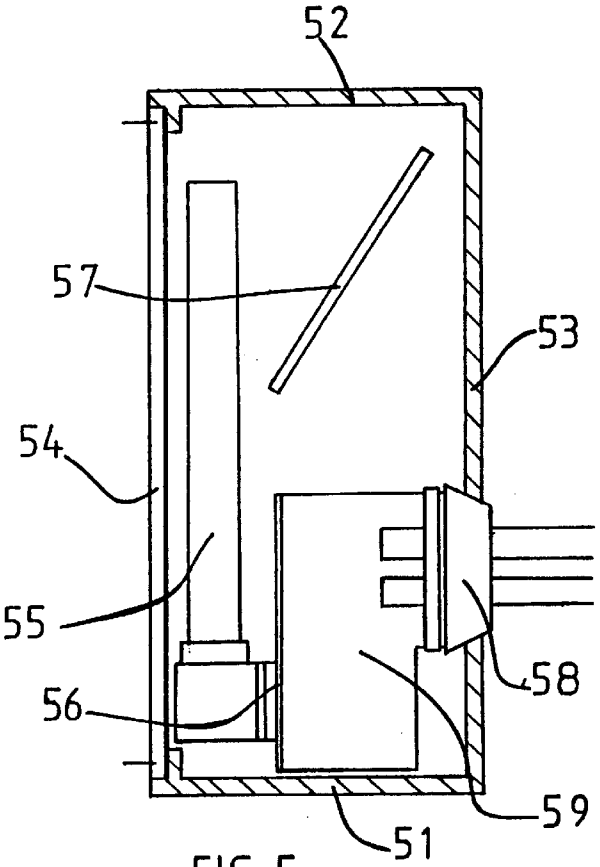
FIG. 5 is a lateral section from above showing a unit similar to that depicted in FIG. 3, including the light unit.

FIG. 5 is a lateral section through a unit similar to that shown with reference to FIG. 3, the unit consisting of end walls 51, 52, a rear wall 53 and a transparent front face 54. The light unit is shown at 55, with reflectors being positioned at 56, 57; electrical cables are fed through grommet 58 for connection to ballast (not shown) in space 59.

Figure 6:
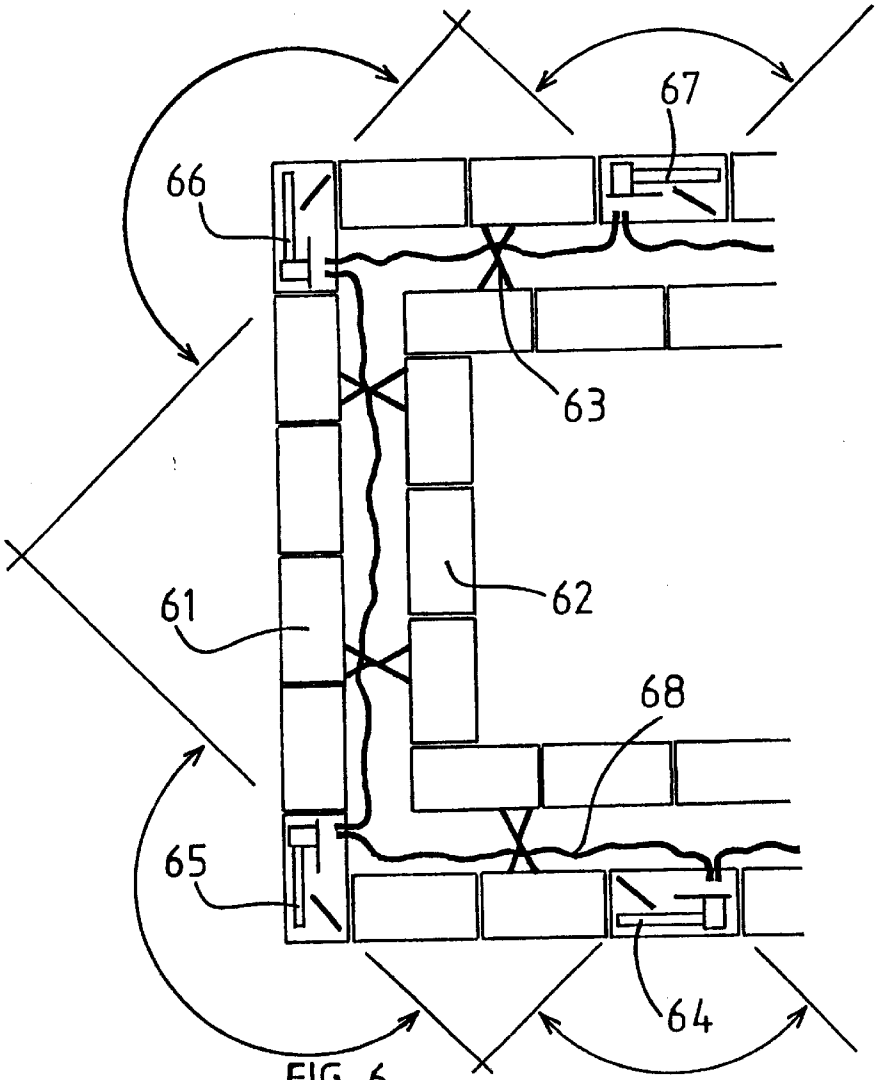
FIG. 6 is a diagrammatic view illustrating how structural units may be incorporated in brick walls.

FIG. 6 shows a plan view of a cavity wall constituted by outer-facing bricks 61 and inner blocks 62 connected by masonry ties 63. Light transmitting units according to the invention are incorporated periodically, as shown at 64, 65, 66 and 67, connected by a ring cable 68. As shown, the units 65, 66 at the corner positions each have transparent end faces as well as front faces, whereby light can be distributed over a greater arc than is the case with units 64, 67.

All the units as illustrated can be formed from reinforced plastics materials with polycarbonate transparent faces; the reinforcing elements 33, 34 shown in FIG. 3 may be formed from steel or aluminium.

What is claimed is:

1. A structural building unit comprising a hollow load-bearing body defined by end walls, each end wall including a strength providing means for providing increased compressive strength which comprises spaced apart walls which have a vertical orientation when in use, and segments connection said spaced apart walls, and having essentially planar opposed faces which in use are disposed horizontally, and at least one other face which is transmissive to electromagnetic radiation and the interior of the body having a cavity which is adapted for receiving a device that is associated with the electromagnetic radiation that can pass through said at least one other face; said building unit being comprised of a first section and a second section which in use abut each other and are oriented as an upper section and a lower section.

2. A unit according to claim 1, in which the body has a rectangular parallelapiped shape.

3. A unit according to claim 1, further including internal strengthening ribs or braces to enhance the crush resistance of the unit.

4. A structural building unit as claimed in claim 1 wherein said strength providing means further comprises a central pillar extending from said opposed faces.

5. A structural building unit as claimed in claim 1 wherein said strength providing means further comprises a first central pillar portion integral with said first section and a second central pillar portion integral with said second section, said pillar portions having a height and a location in their respective sections such that said pillar portions are in an abutting, mating relationship so as to add to the compressive strength of said structural building unit when said building unit sections are joined together.

6. A structural building unit as claimed in claim 1 wherein said electromagnetic radiation associated device is associated with electromagnetic radiation by emitting such radiation.

7. A structural building unit as claimed in claim 1 wherein said electromagnetic radiation associated device is associated with electromagnetic radiation by being radiation sensitive thereto.

* * * * *